US008170878B2

(12) United States Patent
Liu et al.

(10) Patent No.: US 8,170,878 B2
(45) Date of Patent: May 1, 2012

(54) METHOD AND APPARATUS FOR AUTOMATICALLY CONVERTING VOICE

(75) Inventors: Yi Liu, Beijing (CN); Yong Qin, Beijing (CN); Qin Shi, Beijing (CN); Zhi Wei Shuang, Beijing (CN)

(73) Assignee: International Business Machines Corporation, Armonk, NY (US)

( * ) Notice: Subject to any disclaimer, the term of this patent is extended or adjusted under 35 U.S.C. 154(b) by 945 days.

(21) Appl. No.: 12/181,553

(22) Filed: Jul. 29, 2008

(65) Prior Publication Data

US 2009/0037179 A1 Feb. 5, 2009

(51) Int. Cl.
*G10L 19/00* (2006.01)

(52) U.S. Cl. ..... 704/260; 704/235; 704/258

(58) Field of Classification Search ..... 704/235, 704/258, 260

See application file for complete search history.

(56) References Cited

U.S. PATENT DOCUMENTS

| | | | | |
|---|---|---|---|---|
| 4,241,235 | A * | 12/1980 | McCanney | 381/61 |
| 4,624,012 | A * | 11/1986 | Lin et al. | 704/261 |
| 5,113,499 | A * | 5/1992 | Ankney et al. | 340/5.74 |
| 5,970,459 | A | 10/1999 | Yang | |
| 6,792,407 | B2 * | 9/2004 | Kibre et al. | 704/260 |
| 2005/0049875 | A1 * | 3/2005 | Kawashima et al. | 704/266 |
| 2005/0203743 | A1 * | 9/2005 | Hain et al. | 704/258 |
| 2006/0039682 | A1 | 2/2006 | Chen | |
| 2007/0156408 | A1 | 7/2007 | Saito | |
| 2007/0185715 | A1 | 8/2007 | Wei | |
| 2008/0195386 | A1 * | 8/2008 | Proidl et al. | 704/235 |
| 2008/0235024 | A1 * | 9/2008 | Goldberg et al. | 704/260 |
| 2009/0281807 | A1 * | 11/2009 | Hirose et al. | 704/254 |

FOREIGN PATENT DOCUMENTS

JP 2005266349 A * 9/2005

OTHER PUBLICATIONS

IBM, "Efficient multilingual dubbing of movies based on existing sub-titles", ip.com, IPCOM000033305D, Dec. 6, 2004.

Sundermann, et al, "TC-Star: Cross-Language Voice Conversion Revisited", TC-Star Workshop on Speech-to-Speech Translation, Jun. 19, 2006, pp. 231-236, Spain.

* cited by examiner

*Primary Examiner* — Daniel D Abebe

(74) *Attorney, Agent, or Firm* — William Stock; Anne Vachon Dougherty

(57) ABSTRACT

The invention proposes a method and apparatus for significantly improving the quality of voice morphing and guaranteeing the similarity of converted voice. The invention sets several standard speakers in a TTS database, and selects the voices of different standard speakers for speech synthesis according to different roles, wherein the voice of the selected standard speaker is similar to the original role to a certain extent. Then the invention further performs voice morphing on the standard voice similar to the original voice to a certain extent, in order to accurately mimic the voice of the original speaker, so as to make the converted voice closer to the original voice features while guaranteeing the similarity.

20 Claims, 11 Drawing Sheets

METHOD AND APPARATUS FOR AUTOMATICALLY CONVERTING VOICE

TECHNICAL FIELD

The present invention relates to the field of voice conversion, and more particularly to a method and apparatus for performing voice synthesis and voice morphing on text information.

BACKGROUND ART

When people are watching an audio/video file (such as a foreign movie), the language barrier usually makes a significant reading obstacle. Current film distributors can translate foreign subtitles (such as English) into local-language subtitles (such as Chinese) in a relative short period, and synchronistically distribute a movie with local-language subtitles for audiences to enjoy. However, the watching experience of most audiences can still be affected by reading subtitles, because the audience must switch rapidly between the subtitles and the scene. Especially for children, aged people, people with visual disabilities, or people with reading disabilities, the negative effect resulting from reading subtitles is particularly notable. To take audience markets in other regions into account, the audio/video file distributors may hire dubbing actors to endow the audio/video file with Chinese (or other language) dubbing. Such procedures, however, often require a long time to complete and consume great manpower effort.

Text to Speech (TTS) technology is able to convert text information into voice information. U.S. Pat. No. 5,970,459 provides a method for converting movie subtitles into local voices with TTS technology. The method analyzes the original voice data and the shape of the lips of the original speaker, converts text information into voice information with the TTS technology, then synchronizes the voice information according to the motion of the shape of lip, thereby establishing a dubbed effect in the movie. Such a scheme, however, does not make use of voice morphing technology to make the synthesized voices similar to the role players' original voices, so that the resulting dubbed effect differs greatly from the acoustic features of the original voice.

The voice morphing technology can convert the voice of an original speaker into that of a target speaker. In prior art, the frequency warping method is often used for converting the sound frequency spectrum of an original speaker into that of a target speaker, such that the corresponding voice data can be produced according to the acoustic features of the target speaker including speaking speed and tone. The frequency warping technology is a method for compensating for the difference between the sound frequency spectrums of different speakers, which is widely applied to the field of speech recognition and voice conversion. In light of the frequency warping technology, given a frequency spectrum section of a voice, the method generates a new frequency spectrum section by applying a frequency warping function, making the voice of one speaker sound like that of another speaker.

A number of automatic training methods for discovering a good-performance frequency warping function have been proposed in prior art. One method is maximum likelihood linear regression. The description of the method may be referred to: L. F. Uebel and P. C. Woodland, "An investigation into vocal tract length normalization", EUROSPEECH' 99, Budapest, Hungary, 1999, pp. 2527-2530. However, this method needs a great amount of training data, which restricts its usage in many application situations.

Another method is to perform voice conversion with the formant mapping technology. The description of the method may be referred to: Zhiwei Shuang, Raimo Bakis, Yong Qin, "Voice Conversion Based on Mapping Formants" in Workshop on Speech to Speech Translation, Barcellona, June 2006. In particular, the method obtains a frequency warping function according to the relationship between the formants of a source speaker and a target speaker. A formant refers to some frequency areas with heavier sound intensity formed in the sound frequency spectrum due to the resonance of the vocal tract itself during pronunciation. A formant is related to the shape of the vocal tract so that the formant of each person is usually different. The formants of different speakers may be used for representing acoustic differences between different speakers. And the method also makes use of the fundamental frequency adjustment technology so that only a few training data are enough to perform frequency warping of a voice. However, the problem having not being solved by this method is that, if the voice of the original speaker differs far from that of the target speaker, the sound quality impairment resulting from the frequency warping will increase rapidly, thereby impairing the quality of the output voice.

In fact, when measuring the relative merits of voice morphing, there are two indices: one is the quality of the converted voice, another is the degree of similarity between the converted voice and the target speaker. In prior art, these two indices are often restrict by each other. It is difficult to satisfy them at the same time. That is to say, even though the current voice morphing technology is applied to the dubbing method in U.S. Pat. No. 5,970,459, it is still difficult to produce a good dubbed effect.

SUMMARY OF THE INVENTION

In order to solve the above problems in prior art, the present invention proposes a method and apparatus for significantly improving the quality of voice morphing and guaranteeing the similarity of converted voice. The invention sets several standard speakers in a TTS database, and selects the voices of different standard speakers for voice synthesis according to different roles, wherein the voice of the selected standard speaker is similar to the original role to a certain extent. Then the invention further performs voice morphing on the standard voice similar to the original voice to a certain extent, in order to accurately mimic the voice of the original speaker, so as to make the converted voice closer to the original voice features while guaranteeing the similarity.

In particular, the present invention provides a method for automatically converting voice, the method comprising: obtaining source voice information and source text information; selecting a standard speaker from a TTS database according to the source voice information; synthesizing the source text information to standard voice information according to the standard speaker selected from the TTS database; and performing voice morphing on the standard voice information according to the source voice information to obtain target voice information.

The present invention also provides a system for automatically converting voice, the system comprising: means for obtaining source voice information and source text information; means for selecting a standard speaker from a TTS database according to the source voice information; means for synthesizing the source text information to standard voice information according to the standard speaker selected from the TTS database; and means for performing voice morphing on the standard voice information according to the source voice information to obtain target voice information.

The present invention also provides a media playing apparatus, the media playing apparatus at least being used for playing voice information, the apparatus comprising: means for obtaining source voice information and source text information; means for selecting a standard speaker from a TTS database according to the source voice information; means for synthesizing the source text information to standard voice information according to the standard speaker selected from the TTS database; and means for performing voice morphing on the standard voice information according to the source voice information to obtain target voice information.

The present invention also provides a media writing apparatus, the apparatus comprising: means for obtaining source voice information and source text information; means for selecting a standard speaker from a TTS database according to the source voice information; means for synthesizing the source text information to standard voice information according to the standard speaker selected from the TTS database; means for performing voice morphing on the standard voice information according to the source voice information to obtain target voice information; and means for writing the target voice information into at least one storage apparatus.

By utilizing the method and apparatus of the invention, the subtitles in an audio/video file may be automatically converted into voice information according to voices of original speakers. The quality of voice conversion is further improved, while the similarity between the converted voice and the original voice is guaranteed, such that the converted voice is more realistic.

The above description roughly lists the advantages of the invention. These and other advantages of the invention will be more apparent from the following description of the invention taken in conjunction with the figures.

BRIEF DESCRIPTION OF THE DRAWINGS

The figures referenced in the invention are only for illustrating the typical embodiments of the present invention, and should not be construed to limit the scope of the invention.

DETAILED DESCRIPTION OF THE INVENTION

In the following discussion, a number of particular details are provided to assist in understanding the present invention thoroughly. However, it will be apparent to those skilled in the art that the understanding of the invention will not be affected without those particular details. And it is noted that the use of any of the following particular terms is only for the convenience of description, therefore the invention should not be limited to any of the specific applications identified or implied by such terms.

Unless otherwise stated, the functions depicted in the present invention may be executed by hardware, software, or their combination. In a preferred embodiment, however, unless otherwise stated, the functions are executed by a processor, such as a computer or electrical data processor, according to codes, such as computer program codes. In general, the method executed for implementing the embodiments of the invention may be a part of an operating system or a specific application program, a program, a module, an object, or an instruction sequence. Software of the invention usually comprises numerous instructions to be presented by a local computer as a machine-readable format, thereby being executable instructions. Furthermore, a program comprises variables and data structures that reside locally with respect to the program or are found in a memory. Moreover, the various programs described hereinbelow may be identified according to the application methods implementing them in the specific embodiments of the prevent invention. When carrying the computer-readable instructions directed to the functions of the invention, such signal carrying medium represents the embodiment of the present invention.

Figure 1:
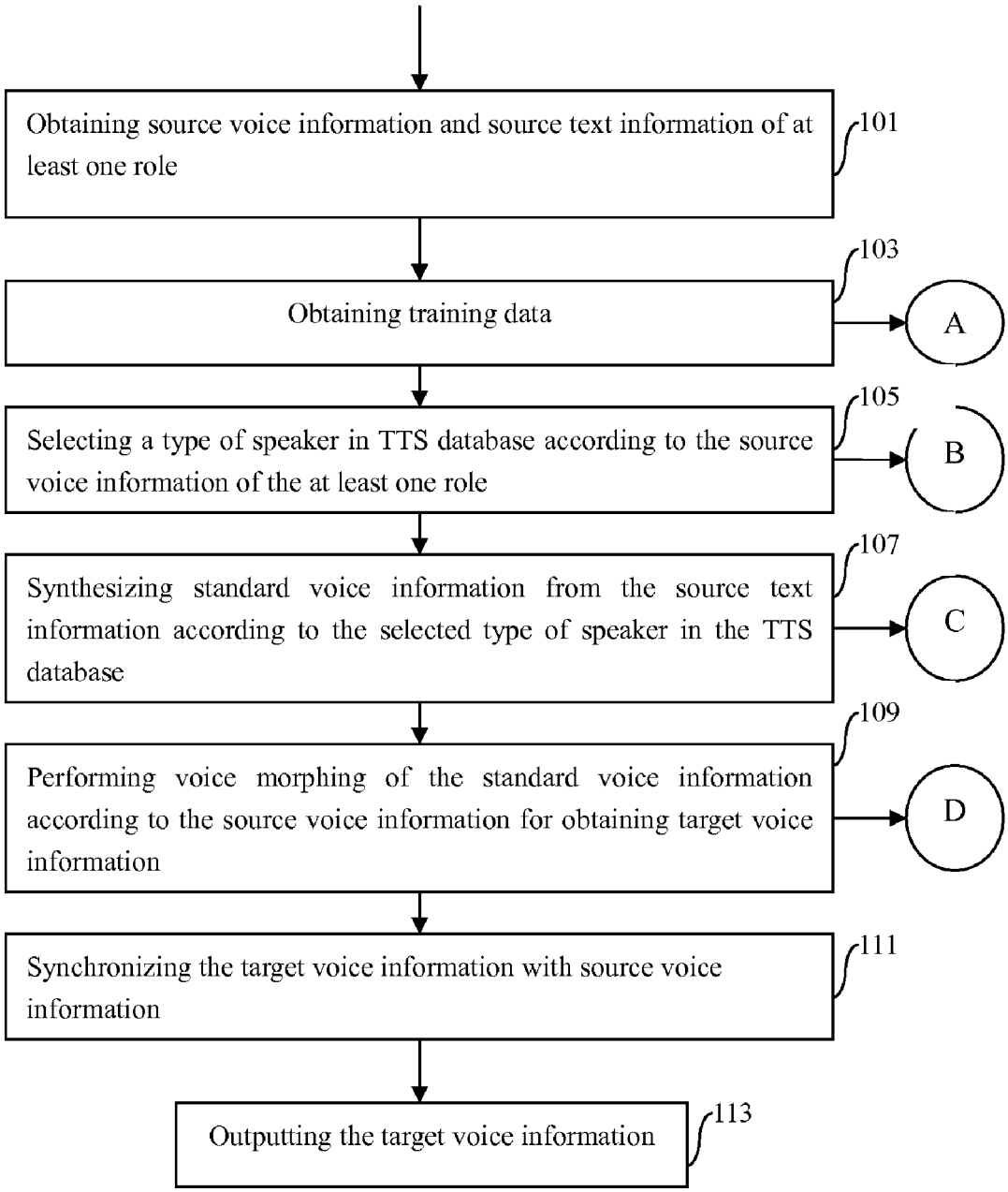
FIG. 1 is a flowchart of voice conversion.

The invention is demonstrated by taking an English movie file with Chinese subtitles as an example. Those having ordinary skill in the art, however, appreciate that the invention is not limited to such application situation. FIG. 1 is a flowchart of voice conversion. Step 101 is used for obtaining the source voice information and the source text information of at least one role. For example, the source voice information may be the original voice of the English movie:

Tom: I'm afraid I can't go to the meeting tomorrow.

Chris: Well, I'm going in any event.

The source text information may be the Chinese subtitles corresponding to the sentences in the movie clip:

*汤姆：我恐怕不能参加明天的会议了。*

*克莉丝：好吧，但无论如何我会去的。*

Step 103 is used for obtaining training data. The training data comprises voice information and text information, wherein the voice information is used for the subsequent selection of a standard speaker and voice morphing, and the text information is used for speech synthesis. In theory, if the provided voice information and text information are strictly aligned with each other, and the voice information has been well partitioned, this step may be omitted. However most of the current movie files cannot provide ready-for-use training data. Therefore it is necessary for the invention to preprocess the training data prior to voice conversion. This step will be described in greater detail in the following.

Step 105 is used for selecting a speaker type from a TTS database according to the source voice information of the at least one role. The TTS refers to a process of converting text information into voice information. The voices of several standard speakers are stored in the TTS database. Traditionally, the voice of only one speaker can be stored in the TTS database, such as one segment or several segments of transcription of an announcer of a TV station. The stored voice takes each sentence as one unit. And the number of the stored unit sentences can be varied depending on different requirements. Experience indicates that it is necessary to store at least hundreds of sentences. In general, the number of stored unit sentences is approximately 5000. Those having ordinary skill in the art appreciate that the greater the number of stored unit sentences the richer the voice information available for synthesis. The unit sentence stored in the TTS database may be partitioned into several smaller units, such as a word, a syllable, a phoneme, or even a voice segment of 10 ms. The transcription of the standard speaker in the TTS database may have no relationship to the text to be converted. For example, what is recorded in the TTS database is a segment of news of affairs announced by a news announcer, while the text information to be synthesized is a movie clip. As long as the pronunciation of the "word", "syllable", or "phoneme" contained in the text can be found in the voice units of the standard speaker in the TTS database, the process of speech synthesis can be completed.

The present invention herein adopts more than one standard speaker, in order to make the voice of the standard speaker closer to the original voice in the movie, and reduce sound quality impairment in the subsequent process of voice morphing. The selection of a speaker type in the TTS database is to select a standard speaker whose timbre is closest to the voice of the standard speaker in TTS. Those having ordinary skill in the art appreciate that, according to some basic acoustic features, such as intonation or tone, different voices can be categorized, such as soprano, alto, tenor, basso, child's voice, etc. Such categorization may help to roughly define the source voice information. And such definition process can significantly advance the effect and quality in the process of voice morphing. The finer the categorization is, the better the final conversion effect. But the calculation cost and storage cost realized as a result of finer categorization is also higher. The invention is demonstrated by taking an example of voices of four standard speakers (Female 1, Female 2, Male 1, Male 2), but the invention is not limited to such categorization. More detailed contents will be described hereinbelow.

In Step 107, the source text information is synthesized to standard voice information according to the selected speaker type i.e. the selected standard speaker, in the TTS database. For example, through the selection in Step 105, Male 1 (tenor) is selected as the standard speaker of the sentence of Tom, so that the source text information "我恐怕不能参加明天的会议了" will be expressed by the voice of Male 1. The detailed steps will be described hereinbelow.

In Step 109, voice morphing is performed on the standard voice information according to the source voice information, thus converting to the target voice information. In the previous step, Tom's dialog is expressed by the standard voice of Male 1. Although to a certain extent the standard voice of Male 1 is similar to Tom's voice in the original voice of the movie, e.g. both are male's voices with higher tones, their similarity is very rough. Such dubbed effect will greatly impair the audience's watching experience based on the dubbing voice in the movie. Therefore, the step of voice morphing is necessary to make the voice of Male 1 sound like Tom's acoustic features in the original voice of the movie. After such conversion process, the produced Chinese pronunciation that is very close to Tom's original voice is referred to as the target voice. The more detailed steps will be described hereinbelow.

In Step 111, the target voice information is synchronized with the source voice information. This is because the lengths of time of the Chinese and English expressions of the same sentence are different, for example, the English sentence "I'm afraid I can't go to the meeting tomorrow" is probably slightly shorter than the Chinese one "我恐怕不能参加明天的会议了", wherein the former spends 2.60 seconds while the latter 2.90 seconds. Thus, the resulting common problem is that the role player in the scene has finished talking while the synthesized voice continues. Of course it is also possible that the role player in the scene has not finished talking while the target voice has stopped. Therefore, it is necessary to synchronize the target voice with the source voice information or the scene. As the source voice information and the scene information are usually synchronized, there are two approaches to this synchronization process: one is to synchronize the target voice information with the source voice information, another is to synchronize the target voice information with the scene information. They will be described hereinbelow, respectively.

In the first synchronization approach, the start and end time of the source voice information can be employed for synchronization. The start and end time may be obtained by way of the simple mute detection, or may be obtained by way of aligning the text information with the voice information (for example, given the time position of the source voice information "I'm afraid I can't go to the meeting tomorrow" is from 01:20:00,000 to 01:20:02,600), the time position of the Chinese target voice corresponding to the source text information "我恐怕不能参加明天的会议了" should also be adjusted as from 01:20:00,000 to 01:20:02,600). After obtaining the start and end time of the source voice information, the start time of the target voice information is set to be consistent with that of the source voice information (such as 01:20:00,000). In the mean time, the length of time of the target voice information will be adjusted (such as from 2.90 seconds to 2.60 seconds) in order to ensure the end time of the target voice is consistent with that of the source voice. Note that the adjustment of the length of time is generally steady (such as a sentence of 2.90 seconds hereinabove is steadily compressed into 2.60 seconds), thereby ensuring the compression on each syllable is consistent, so that it is ensured that a sentence after compression or extension still sounds natural and smooth. Of course, for some very long sentences with obvious pauses, they can be divided into several segments for synchronization.

In the second synchronization approach, the target voice is synchronized according to the scene information. Those having ordinary skill in the art appreciate that the facial information, especially the lip information, of a role can express the voice synchronization information approximately exactly. For some simple situations, such as a single speaker in a fixed background, the lip information can be well recognized. The start and end time of the voice can be determined by way of the recognized lip information. Thus, the length of time of the target voice is adjusted and the time position of the target voice is set in the similar way as above.

It is noted that, in one embodiment, the above synchronization step may be performed solely after the voice morphing, while in another embodiment, the above synchronization step may be performed simultaneously with the voice morphing. The latter embodiment can probably bring a better effect. Since every processing on a voice signal can result in voice quality impairment due to the inherent defect brought by the voice analysis and reconstruction, completing the two steps simultaneously can reduce the amount of processing on the voice data, thereby further improving the quality of the voice data.

At last, in Step 113, the synchronized target voice data is output along with the scene or text information, thereby producing an automatically dubbed effect.

Figure 2:
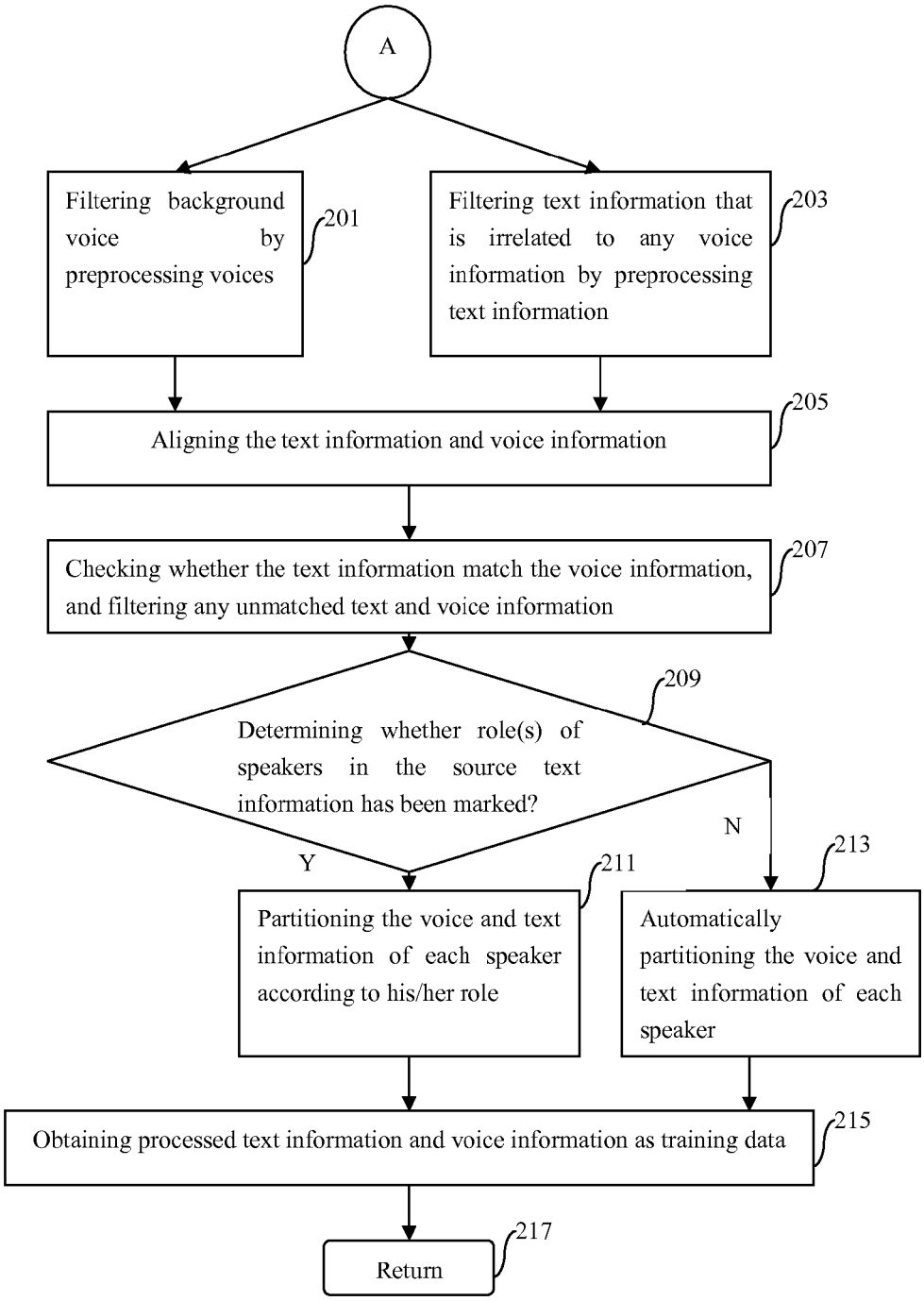
FIG. 2 is a flowchart of obtaining training data.

The process of obtaining training data is described below with reference to FIG. 2. In Step 210, at first, the voice information is preprocessed to filter background sound. Voice data, especially the voice data in a movie, may contain strong background noises or music sounds. When used for training, such data may impair the training result. So it is necessary to eliminate the background sounds and only keep the pure voice data. If the movie data is stored according to the MPEG protocol, it is possible to automatically distinguish different voice channels, such as a background voice channel 1105 and a foreground voice channel 1107 in FIG. 11. However, if the foreground voice and background voice are not distinguished in the source audio/video data, or even though they are distinguished, some voice sounds of non-voice or without corresponding subtitles (such as wild hubbub by a group of children) are still mixed in the foreground voice, the above filtering step can be performed. Such filtering process may be performed with the Hidden Markov Model (HMM) used in speech recognition technology. The model well describes the characters of voice phenomenon, and the HMM-based speech recognition algorithm achieves good recognition results.

In Step 203, the subtitles are preprocessed to filter the text information without corresponding voice information. As some explanatory non-voice information may be contained in subtitles, these parts of information do not need speech synthesis and therefore need to be filtered in advance. For example:

00:00:52,000→00:01:02,000

<font color="#ffff00">www.1000fr.com present</font>

A simple filtering approach is to set a series of special keywords for filtering. Taking the above form of data as an example, we can set keywords as <font> and </font>, so as to filter information between the two keywords. Such explanatory text information in an audio/video file is always regular. So setting a keyword filtering set can substantially satisfy most filtering requirements. Of course, when filtering lots of unpredictable explanatory text information, other approaches can be employed, for example, finding whether there is voice information corresponding to the text information by the TTS technology. If no voice information can be found corresponding to "<font color="#ffff00">www.1000fr.com present</font>", it is considered that this segment of content should be filtered out. Furthermore, in some simple examples, the original audio/video file may not contain the explanatory text information, thus the above filtering step is not needed. Furthermore, it is noted that Step 201 and 203 have no specific sequencing restriction, i.e. their sequence can be interchanged.

In Step 205, it is necessary to align the text information with the voice information, i.e. the start time and the end time of a segment of text information correspond to those of a segment of source voice information. After alignment, the corresponding source voice information can be exactly extracted as voice training data for a sentence of text information for use in the steps of standard speaker selection, voice morphing, and locating the time position of the ultimate target voice information. In one embodiment, if the subtitle information itself contains the temporal start point and end point of an audio stream (i.e. source voice information) corresponding to a segment of text (which is a common case in existing audio/video files), it is possible to align the text with the source voice information by way of such temporal information, thereby greatly improving the alignment accuracy. In another embodiment, if the corresponding temporal information is not accurately marked in the segment of text, it is still possible to convert the corresponding source voice into text by speech recognition technology, then search for matching subtitle information, and mark the temporal start point and end point of the source voice on the subtitle information. Those having ordinary skill in the art appreciate that any other algorithms which help to implement the alignment of voice and text fall into the protection scope of the invention.

Occasionally, a mark error may occur in the subtitle information due to the mismatch of text and source voice caused by the original audio/video file manufacturer. A simple correction method is, when the mismatch of text information and voice information is checked, filtering the mismatching text and voice information (Step 207). Note that the matching check focuses on English source voice and English source subtitles, as the check with the same language can greatly reduce the calculation cost and difficulty. It can be implemented by converting the source voice into text and performing matching calculations with the English source subtitles, or by converting the source English subtitles into voice and performing matching calculations with the English source voice. Of course, for a simple audio/video file with well-corresponding subtitles and voice, the above matching step can be omitted.

In the following Steps 209, 211, 213, data of different speakers is partitioned. In Step 209, it is determined whether the roles of speakers in the source text information have been marked. If the speaker information has been marked in the subtitle information, the text information and the voice information corresponding to different speakers can be easily partitioned with such speaker information.

For example:

Tom: I'm afraid I can't go to the meeting tomorrow.

Herein, the role of speaker is directly identified with Tom, so that the corresponding voice and text information can be directly treated as the training data of speaker Tom, thereby partitioning the voice and text information of each speaker according to his/her role (Step 211). In contrast, if the speaker information has not been marked in the subtitle information, it is necessary to further partition the voice information and text information of each speaker (Step 213), i.e. to automatically categorize the speakers. In particular, all source voice information can be automatically categorized by means of the features of frequency spectrum and prosodic structure of speakers, thereby forming several categories, so as to obtain the training data for each category. Afterwards, a specific speaker identification, such as "Role A", can be assigned to each category. It is noted that the result of the automatic categorization may categorize different speakers into the same category because their acoustic features are very similar, or may categorize different voice segments of the same speaker into several categories because the acoustic features of the speaker in different contexts represent a distinct difference (for example, one's acoustic features in anger and in happiness are evidently different). However such categorization will not excessively influence the final dubbed effect, as the subsequent process of voice morphing can still make the output target voice close to the pronunciation of the source voice.

In Step 215, the processed text information and source voice information can be treated as training data for use.

Figure 3:
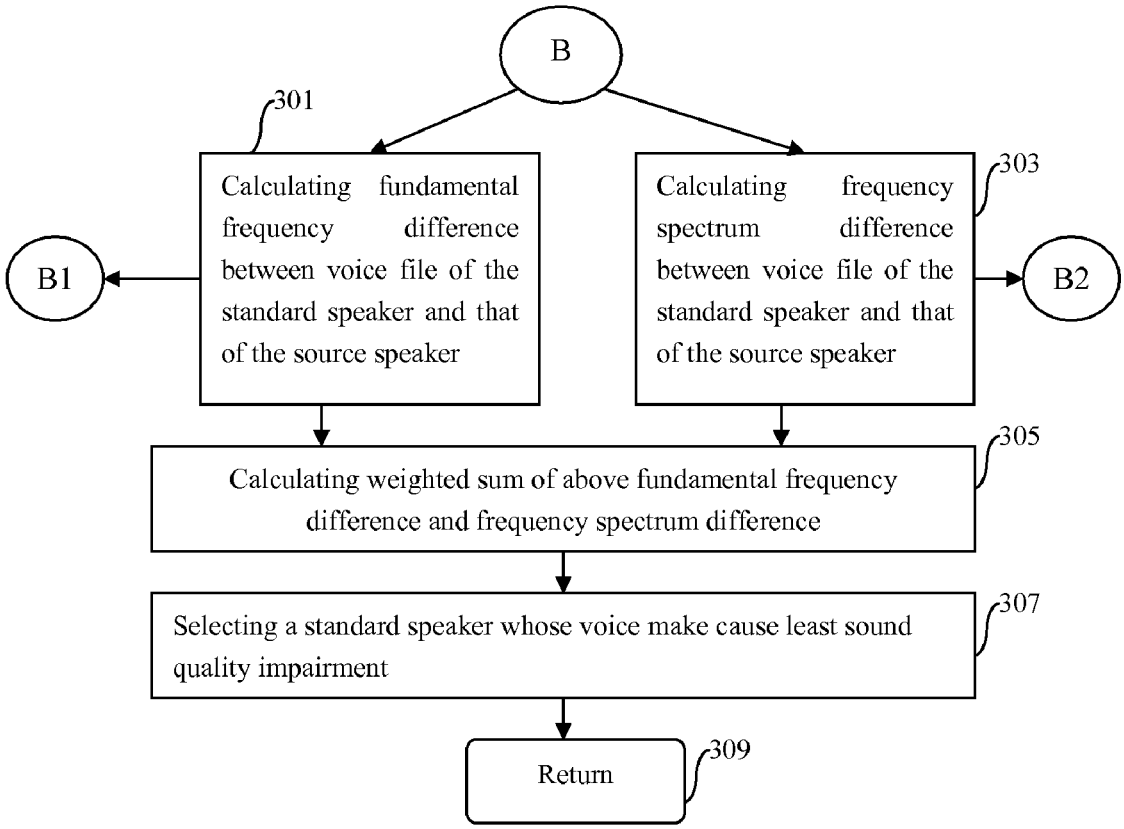
FIG. 3 is a flowchart of selecting a speaker type from a TTS database.

FIG. 3 is a flowchart of selecting a speaker type from a TTS database. As depicted above, the purpose of selecting a standard speaker is to make the voice of the standard speaker used in the step of speech synthesis as close to the source voice as possible, thereby reducing the sound quality impairment brought about by the subsequent step of voice morphing. Because the process of standard speaker selection directly determines the relative merits of the subsequent voice morphing, the particular method of standard speaker selection is associated with the method of voice morphing. In order to search for the voice of a standard speaker whose acoustic features have minimum difference from the source voice, the following two factors can be approximately used for measuring the difference of acoustic features: one is difference in the fundamental frequency of voice (also referred to as the prosodic structure difference), usually represented by $F_0$; another is difference in the frequency spectrum of voice, which can be represented by formant frequencies $F_1 \ldots F_n$. In a natural compound tone, a component tone with maximum amplitude and minimum frequency is generally referred to as "fundamental tone", whose vibration frequency is referred to as "fundamental frequency". Generally speaking, the perception of pitch mainly depends on the fundamental frequency. Since the fundamental frequency reflects the vibration frequency of vocal cords, which is unrelated to the particular speaking content, it is also referred to as a suprasegmental feature. The formant frequencies $F_1 \ldots F_n$ reflect the shape of the vocal cords, which is related to the particular speaking contents, it is also referred to as segmental feature. The two frequencies jointly define the acoustic features of a segment of voice. A standard speaker with minimum voice difference is selected by the invention according to the two features, respectively.

Figure 4:
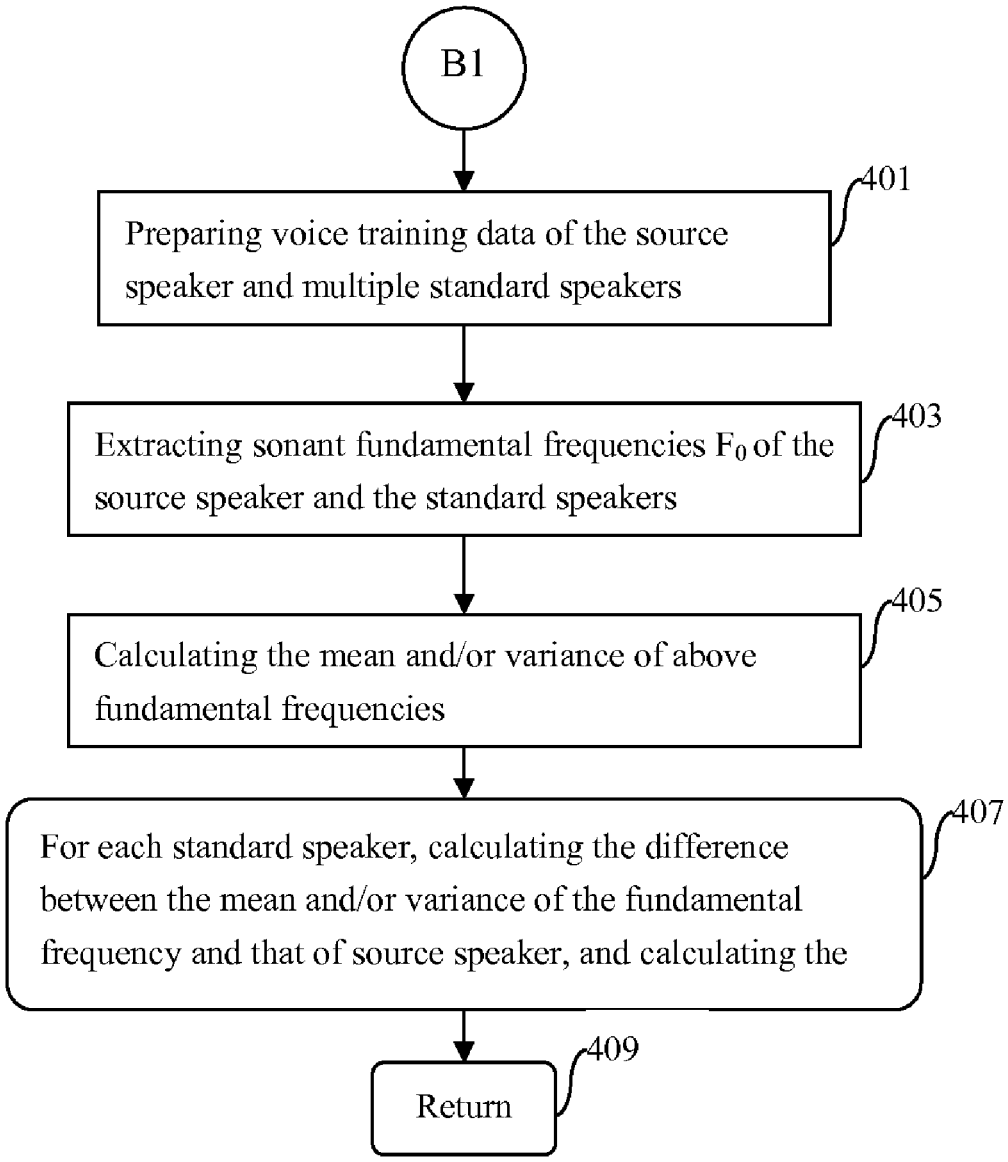
FIG. 4 is a flowchart of calculating the fundamental frequency difference between the standard speakers and the source speaker.

In Step 301, the fundamental frequency difference between the voice of a standard speaker and the voice of the source speaker is calculated. In particular, with respect to FIG. 4, in Step 401, the voice training data of the source speaker (such as Tom) and multiple standard speakers (such as Female 1, Female 2, Male 1, Male 2) are prepared.

In Step 403, the fundamental frequencies $F_0$ of the source speaker and the standard speakers are extracted corresponding to multiple sonant segments. Then the mean and/or variance of the logarithm domain fundamental frequencies log ($F_0$) are calculated, respectively (Step 405). And for each standard speaker, the difference between the mean and/or variance of his/her fundamental frequency and that of the source speaker is calculated, and the weighted distance sum of the two differences is calculated (Step 407), for use in selecting a speaker as the standard speaker.

Figure 5:
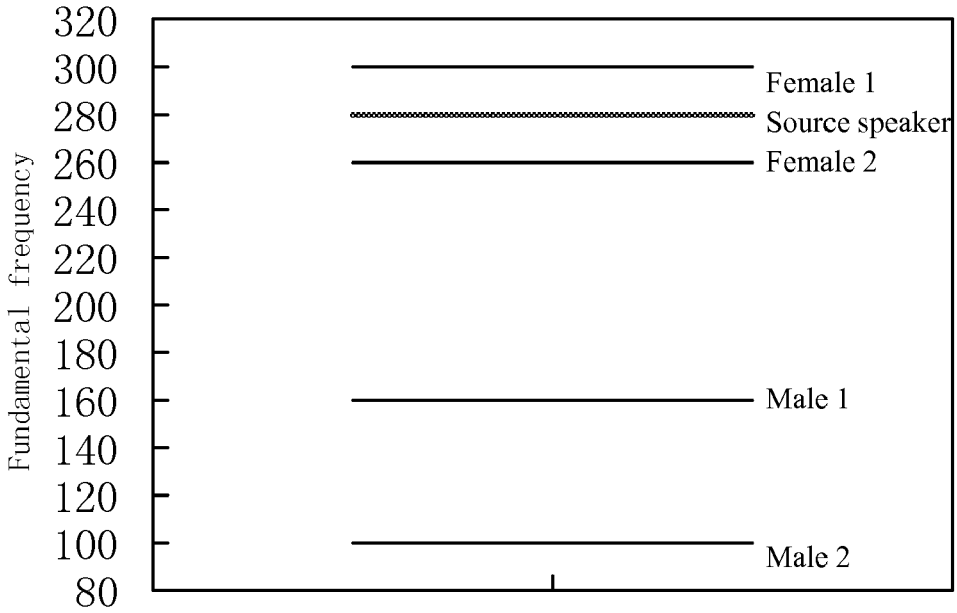
FIG. 5 is a schematic drawing of the means of the fundamental frequency differences between the source speaker and the standard speakers.

FIG. 5 shows the comparison of the means of the fundamental frequency differences between the source speaker and the standard speakers. Assume that the means of the fundamental frequencies of the source speaker and the standard speakers are illustrated as Table 1:

TABLE 1

| | Source speaker | Female 1 | Female 2 | Male 1 | Male 2 |
|---|---|---|---|---|---|
| Mean of fundamental frequency (HZ) | 280 | 300 | 260 | 160 | 100 |

It can be readily seen from Table 1 that the fundamental frequency of the source speaker is closer to that of Female 1 and Female 2, and differs far from that of Male 1 and Male 2.

Figure 6:
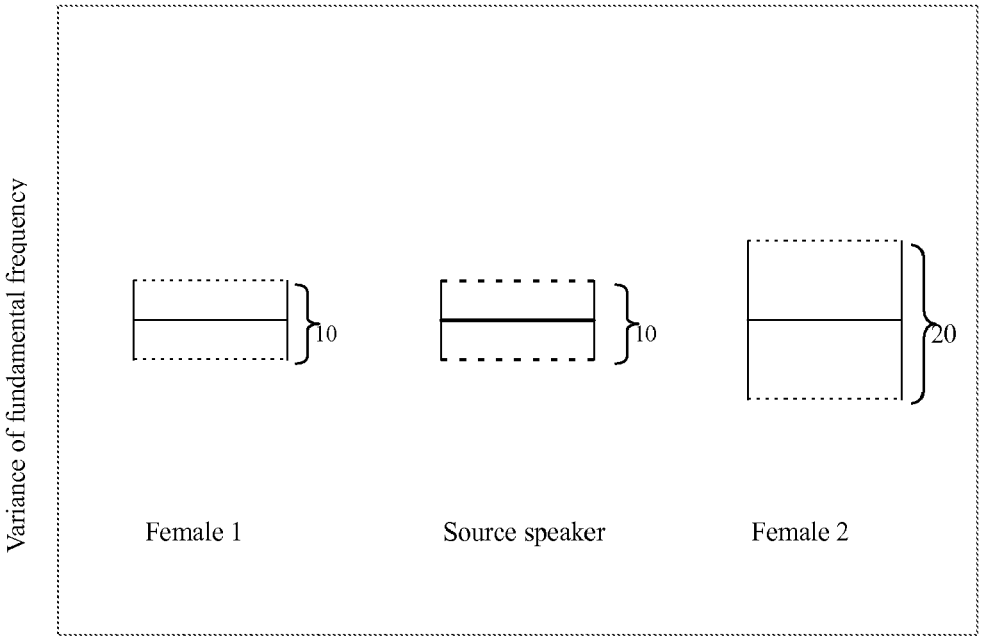
FIG. 6 is a schematic drawing of the variances of the fundamental frequency differences between the source speaker and the standard speakers.

However, if the differences between the mean of fundamental frequency of the source speaker and that of at least two standard speakers are equal (as shown in FIG. 5), or very close, the variances of the fundamental frequencies of the source speaker and the standard speakers can be further calculated. Variance is an index of measuring the varying range of a fundamental frequency. In FIG. 6, the variances of the fundamental frequencies of the three speakers are compared. It is found that the variance of the fundamental frequency of the source speaker (10 HZ) is equal to that of Female 1 (10 HZ), and different from that of Female 2 (20 HZ). So Female 1 can be selected as the standard speaker used in the process of speech synthesis for the source speaker.

Those having ordinary skill in the art appreciate that the above method of measuring fundamental frequency difference is not limited to the examples listed in the specification, but can be varied in various ways, as long as it can guarantee that the sound quality impairment of the filtered standard speaker's voice brought in the subsequent voice morphing is minimum. In one embodiment, the measure of the sound quality impairment can be calculated according to the following formulas:

$$d(r) = \begin{cases} a_+^* r^2, & r > 0 \\ a_-^* r^2, & r < 0 \end{cases}$$

wherein, d(r) denotes the sound quality impairment, r=log ($F_{0S}/F_{0R}$), $F_{0S}$ denotes the mean of the fundamental frequency of the source voice, $F_{0R}$ denotes the mean of the fundamental frequency of the standard voice. a+ and a− are two experimental constants. It can be seen that, although the difference of the means of the fundamental frequencies ($F_{0S}/F_{0R}$) has a certain relationship with the sound quality impairment during voice morphing, the relationship is not necessarily in direct proportion.

Returning to Step 303 of FIG. 3, the frequency spectrum difference between a standard speaker and the source speaker will be further calculated.

Figure 7:
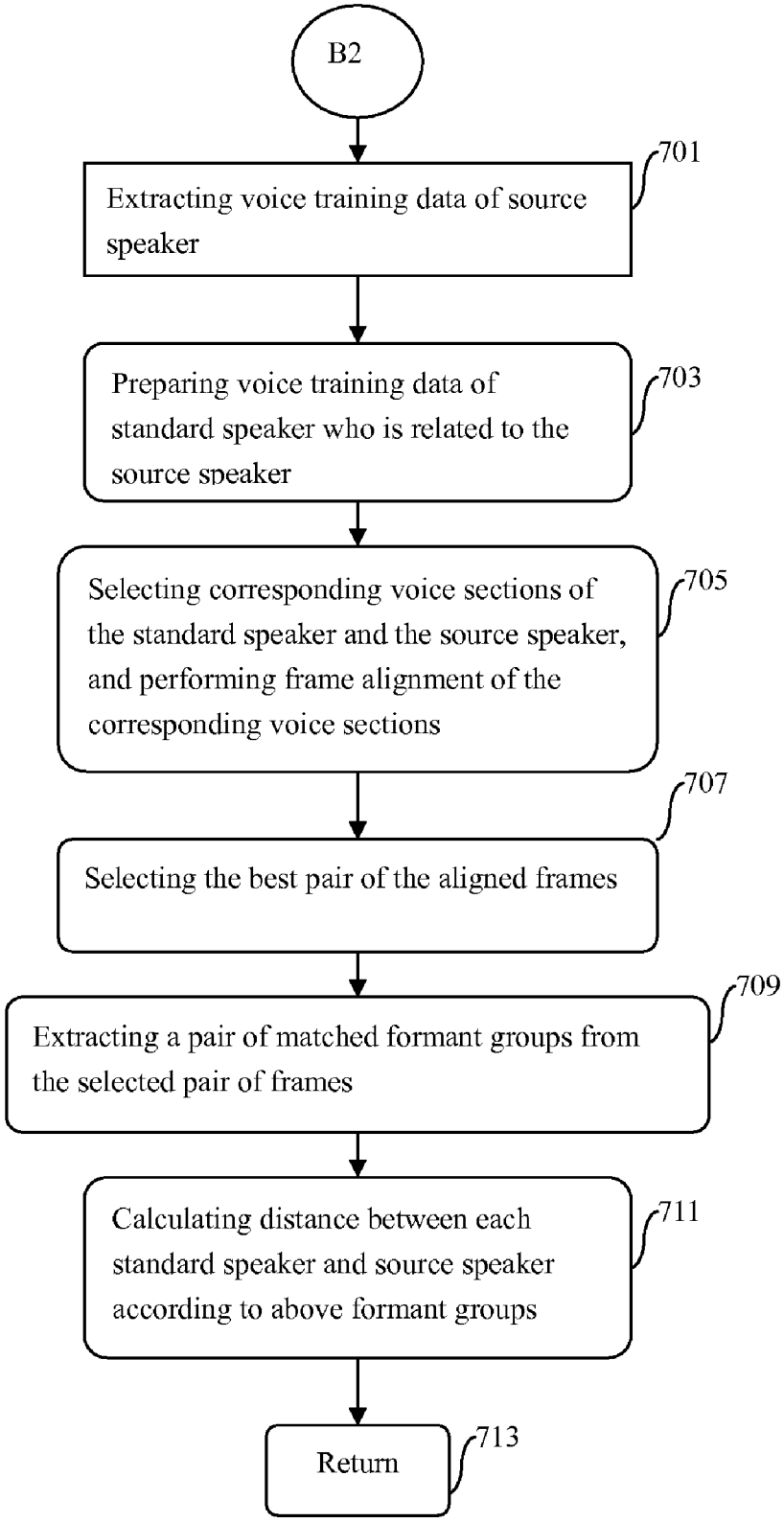
FIG. 7 is a flowchart of calculating the frequency spectrum difference between the standard speaker and the source speaker.

The process of calculating the frequency spectrum difference between the standard speaker and the source speaker is described in detail hereinbelow with reference to FIG. 7. As described above, a formant refers to some frequency areas with heavier sound intensity formed in the sound frequency spectrum due to the resonance of the vocal tract itself during pronunciation. The acoustic features of a speaker are mainly reflected by the first four formant frequencies, i.e. $F_1$, $F_2$, $F_3$, $F_4$. In general, the value range of the first formant $F_1$ is in the range of 300-700 HZ, the value range of the second formant $F_2$ is in the range of 1000-1800 HZ, the value range of the third formant $F_3$ is in the range of 2500-3000 HZ, and the value range of the fourth formant $F_4$ is in the range of 3800-4200 HZ.

The present invention selects a standard speaker who may cause the minimum sound quality impairment by comparing the frequency spectrum differences on several formants of the source speaker and the standard speaker. In particular, in Step 701, at first, the voice training data of the source speaker is extracted. Then in Step 703, the voice training data of the standard speaker corresponding to the source speaker is prepared. It is not required that the contents of the training data are totally identical, but they need to contain the same or similar characteristic phonemes.

Next, in Step 705 the corresponding voice segments are selected from the voice training data of the standard speaker and the source speaker, and frame alignment is performed on the voice segments. The corresponding voice segments have the same or similar phonemes with the same or similar contexts in the training data of the source speaker and the standard speaker. The context mentioned herein includes but is not limited to: adjacent phoneme, position in a word, position in a phrase, position in a sentence, etc. If multiple pairs of phonemes with the same or similar contexts are found, then some certain characteristic phoneme, such as [e], may be preferred. If the found multiple pairs of phonemes with the same or similar contexts are identical to each other, then some certain context may be preferred. The reason is that, in some contexts, a phoneme with a smaller formant will be probably influenced by the adjacent phoneme. For example, a voice segment having a "plosion" or "spirant" or "mute" as its adjacent phoneme is selected. If, for the found multiple pairs of phonemes with the same or similar contexts, their contexts and phonemes are all identical, then a pair of voice segments may be selected randomly.

Afterwards, the frame alignment is performed on the voice segments: in one embodiment, the frame in the middle of the voice segment of the standard speaker is aligned with the frame in the middle of the voice segment of the source speaker. Since a frame in the middle is considered to be with a tiny change, it is less influenced by the adjacent phoneme. In this embodiment, the pair of the frames in the middle is selected as best frames (referring to Step 707), for using for extracting formant parameters in the subsequent step. In another embodiment, the frame alignment can be performed with the known Dynamic Time Warping (DTW) algorithm, thereby obtaining a plurality of aligned frames, and it is preferred to select the aligned frames with minimum acoustic difference as a pair of best-aligned frames (referring to Step 707). In summary, the aligned frames obtained in Step 707 have the following features: each frame can better express the acoustic features of the speaker, and the acoustic difference between the pair of frames is relatively small.

Afterwards, in Step 709, a group of formant parameters matching the pair of selected frames are extracted. Any known method for extracting formant parameters from voice can be employed to extract the group of matching formant parameters. The extraction of formant parameters can be performed automatically or manually. A possible approach is to extract formant parameters by way of some voice analysis tool, such as PRAAT. When extracting the formant parameters of the aligned frames, the extracted formant parameters can be more stable and reliable by utilizing the information of adjacent frames. In one embodiment of the present invention, a frequency warping function is generated by regarding each pair of matching formant parameters in the group of matching formant parameters as keypoints. The group of formant parameters of the source speaker is $[F_{1S}, F_{2S}, F_{3S}, F_{4S}]$, and the group of formant parameters of the standard speaker is $[F_{1R}, F_{2R}, F_{3R}, F_{4R}]$. The examples of the formant parameters of the source speaker and the standard speaker are shown in Table 2. Although the invention takes the first to fourth formant as formant parameters because these parameters can represent the acoustic features of a speaker, the invention is not limited to the case in which more, less, or other formant parameters can be extracted.

TABLE 2

| | First formant ($F_1$) | Second formant ($F_2$) | Third formant ($F_3$) | Fourth formant ($F_4$) |
|---|---|---|---|---|
| Frequency of standard speaker $[F_R]$(HZ) | 500 | 1500 | 3000 | 4000 |
| Frequency of source speaker $[F_S]$ (HZ) | 600 | 1700 | 2700 | 3900 |

In Step 711, according to the above formant parameters, the distance between each standard speaker and the source speaker is calculated. Two approaches to implementing this step are listed below. In the first approach, the weighed distance sum between the corresponding formant parameters is computed directly, and the same weight $W_{high}$ may be assigned to the first three formant frequencies, while a lower weight $W_{low}$ may be assigned to the fourth formant frequency, so as to distinguish the different effects on the acoustic features by different formant frequencies. Table 3 illustrates the distances between the standard speaker and the source speaker calculated based on the first embodiment.

TABLE 3

| | First formant ($F_1$) | Second formant ($F_2$) | Third formant ($F_3$) | Fourth formant ($F_4$) |
|---|---|---|---|---|
| Frequency of standard speaker $[F_R]$ | 500 | 1500 | 3000 | 4000 |
| Frequency of source speaker $[F_S]$ | 600 | 1700 | 2700 | 3900 |
| Formant frequency difference | 100 | 200 | −300 | −100 |
| Weight of formant frequency difference | $W_{high}$ = 100% | $W_{high}$ = 100% | $W_{high}$ = 100% | $W_{low}$ = 50% |
| Distance sum of formant frequencies of two speakers | $(100 + 200 + \lvert -300 \rvert) \times W_{high} + (\lvert -100 \rvert) \times W_{low} = 650$ The difference herein is the sum of absolute values. | | | |

Figure 8:
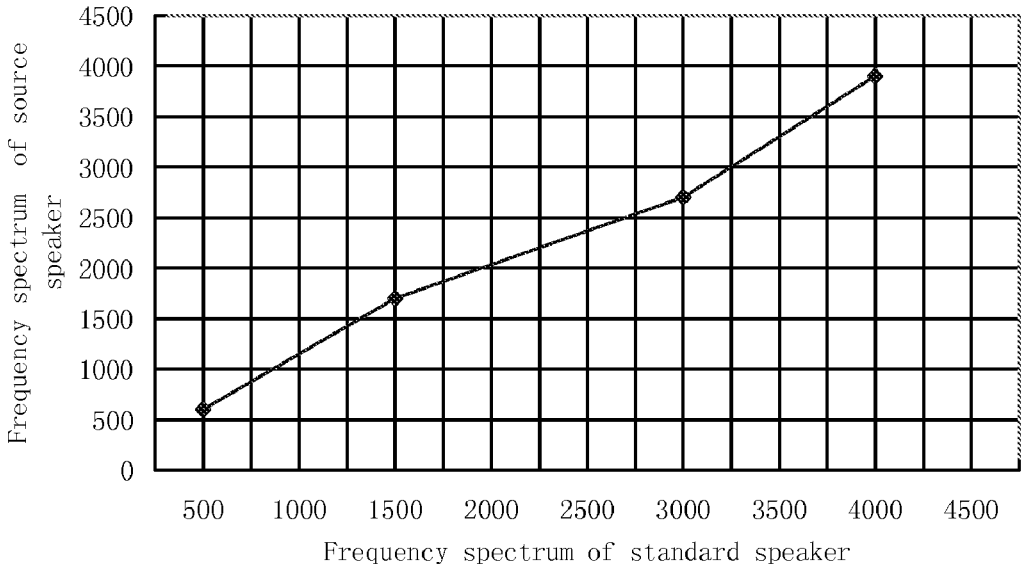
FIG. 8 is a schematic drawing of the comparison of the frequency spectrum difference between the source speaker and the standard speaker.

In the second approach, a piecewise linear function which maps the axis of frequency of the source speaker to the axis of frequency of the standard speaker is defined by utilizing the pair of matching formant parameters $[F_R, F_S]$ as keypoints. Then the distance between the piecewise linear function and the function Y=X is calculated. In particular, the two curve functions are sampled along the X-axis to get respective Y values, and the weighed distance sum between the respective Y values of the sampled points is calculated. The sampling of the X-axis may utilize either equal interval sampling, or unequal interval sampling, such as log domain equal interval sampling, or mel frequency spectrum domain equal interval sampling. FIG. 8 is a schematic drawing of the piecewise linear function of the frequency spectrum difference between the source speaker and the standard speaker according to equal interval sampling. Since the function Y=X is a straight line (not shown in the figure) being symmetrical with respect to the X-axis and the Y-axis, the difference of Y values on each formant frequency [$F_{1R}$, $F_{2R}$, $F_{3R}$, $F_{4R}$] point of each standard speaker between the piecewise linear function shown in FIG. 8 and the function Y=X reflects the difference of the formant frequency of the source speaker and that of the standard speaker.

The distance between a standard speaker and the source speaker, i.e., the voice frequency spectrum difference, can be obtained by means of the above approaches. The voice frequency spectrum difference between each standard speaker, such as [Female 1, Female 2, Male 1, Male 2] and the source speaker can be calculated by repeating the above steps.

Returning to Step 305 in FIG. 3, the weighed distance sum of the above-mentioned fundamental frequency difference and the frequency spectrum difference is calculated, thereby selecting a standard speaker whose voice is closest to the source speaker (Step 307). Those having ordinary skill in the art appreciate that, although the present invention is demonstrated by taking an example of calculating the fundamental frequency difference and the frequency spectrum difference together, such an approach only constitutes one preferred embodiment of the invention, and the invention may also implement many variants: for example, selecting a standard speaker only according to the fundamental frequency difference; or selecting a standard speaker only according to the frequency spectrum difference; or first selecting several standard speakers according to the fundamental frequency difference, then further filtering the selected standard speakers according to the frequency spectrum difference; or first selecting several standard speakers according to the frequency spectrum difference, then further filtering the selected standard speakers according to the fundamental frequency difference. In summary, the purpose of selecting a standard speaker is to select the voice of a standard speaker which has minimum difference from that of the source speaker, such that the voice of the standard speaker which causes the least amount of sound quality impairment can be used for voice morphing (also referred to as voice simulation) in the subsequent process of voice morphing.

Figure 9:
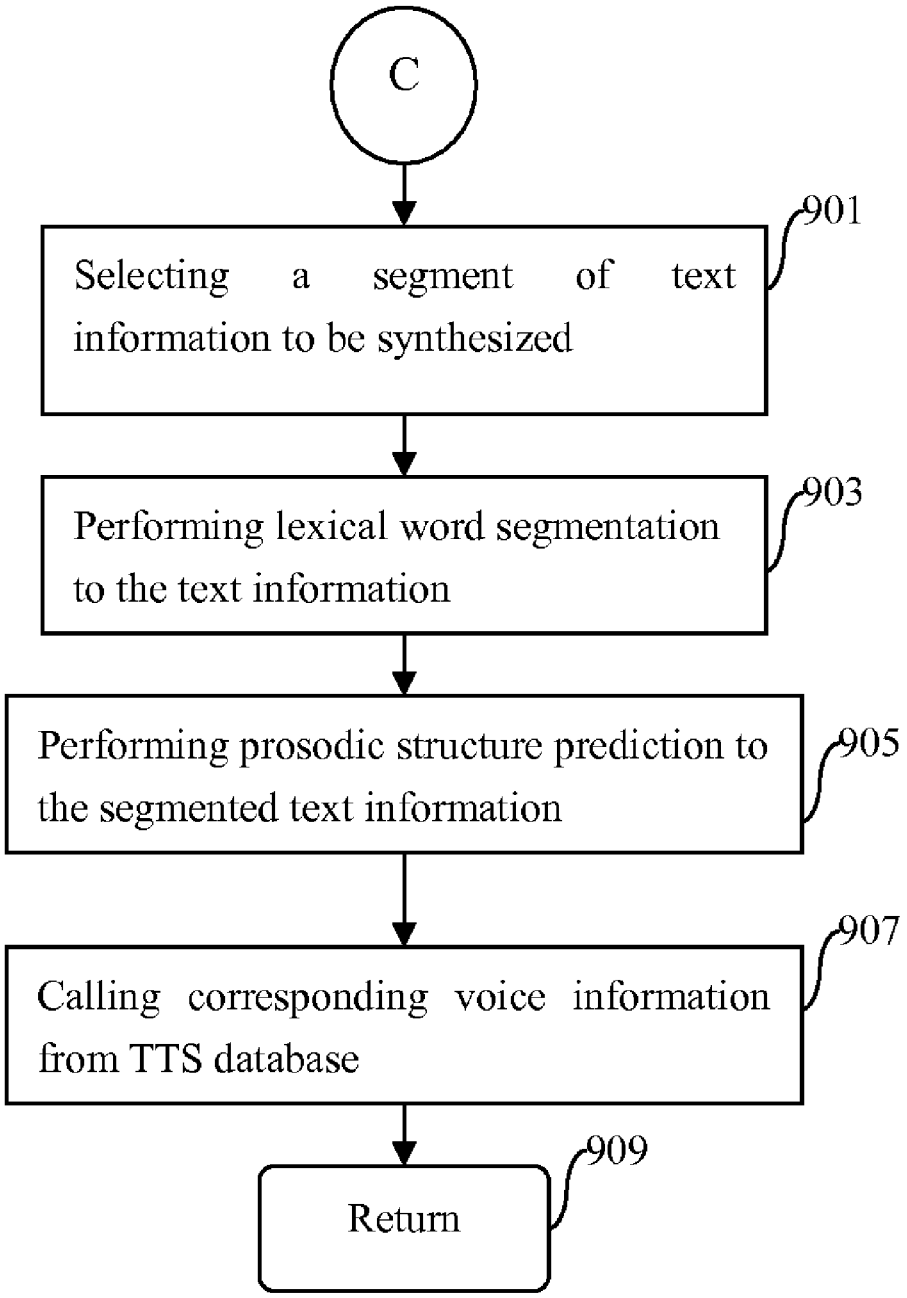
FIG. 9 is a flowchart of synthesizing the source text information into the standard voice information.

FIG. 9 shows a flowchart of synthesizing the source text information into the standard voice information. At first, in Step 901, a segment of text information to be synthesized is selected, such as a segment of the subtitle in the movie "*我恐怕不能参加明天的会议了*". Then in Step 903, the lexical word segmentation is performed on the above text information. Lexical word segmentation is a precondition of text information processing. Its main purpose is to split a sentence into several words according to the natural speaking rules (such as "*[我][恐怕][不能][参加][明天的][会议]了*"). There are many methods for lexical word segmentation. The basic two methods are: a dictionary-based method for lexical word segmentation and a frequency statistic-based method for lexical word segmentation. Of course the invention does not exclude any other methods for lexical word segmentation.

Next in Step 905, prosodic structure prediction is performed on the segmented text information, which may estimate the information of the tone, rhythm, accent position, and length of time of the synthesized voice. Then in Step 907 the corresponding voice information is called from the TTS database, i.e. the voice units of a standard speaker are selected and concatenated together according to the result of prosodic structure prediction, thereby speaking the above text information naturally and smoothly with the voice of the standard speaker. The above process of speech synthesis is usually referred to as concatenative synthesis. Although the invention is demonstrated by taking it as an example, in fact the invention does not exclude any other methods for speech synthesis, such as parameter synthesis.

Figure 10:
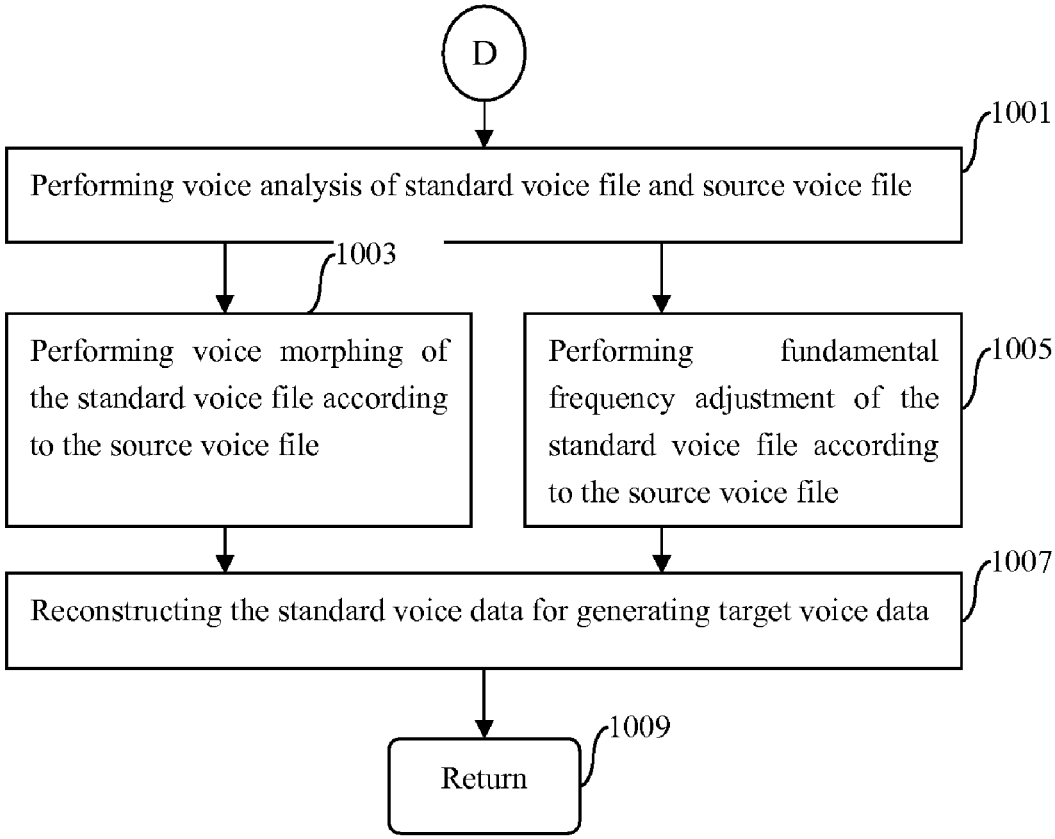
FIG. 10 is a flowchart of performing voice morphing on the standard voice information according to the source voice information.

FIG. 10 is a flowchart of performing voice morphing on the standard voice information according to the source voice information. Since the current standard voice information has already been able to accurately speak in a natural and smooth voice according to the subtitles, the method of FIG. 10 will make the standard voice closer to the source voice. At first, in Step 1001, voice analysis is performed on the selected standard voice file and the source voice file, thereby getting the features of fundamental frequencies and frequency spectrums of the standard speaker and the source speaker, including the fundamental frequency [$F_0$] and formant frequencies [$F_1$, $F_2$, $F_3$, $F_4$], etc. If the above information has been obtained in the previous step, it can be directly utilized without re-extraction.

Next, in Step 1003 and 1005, frequency spectrum conversion and/or fundamental frequency adjustment is performed on the standard voice file according to the source voice file. It is known from the previous descriptions that a frequency warping function (referring to FIG. 8) can be generated with the frequency spectrum parameters of the source speaker and the standard speaker. The frequency warping function is applied to the voice segment of the standard speaker in order to convert the frequency spectrum parameters of the standard speaker to be consistent with those of the source speaker, so as to get the converted voice with high similarity. If the voice difference between the standard speaker and the source speaker is small, the frequency warping function will be closer to a straight line, and therefore the quality of the converted voice will be higher. In contrast, if the voice difference between the standard speaker and the source speaker is big, the frequency warping function will be more flexuous, and therefore the quality of the converted voice will be relatively reduced. In the above steps, since the voice of the selected standard speaker to be converted is approximately close to the voice of the source speaker, the sound quality impairment resulting from voice morphing can be significantly reduced, thereby improving the voice quality while guaranteeing the voice similarity after conversion.

In a similar way, a fundamental frequency linear function can be generated with the fundamental frequency parameters of the source speaker [$F_{0S}$] and the standard speaker [$F_{0R}$], such as $\log F_{0S}=a+b\log F_{0R}$, wherein a and b are constants. Such a fundamental frequency linear function well reflects the fundamental frequency difference between the source speaker and the standard speaker, and such a linear function can be used for converting the fundamental frequency of the standard speaker into that of the source speaker. In a preferred embodiment, the fundamental frequency adjustment and the frequency spectrum conversion can be performed simultaneously without a specific sequence. The invention, however, does not exclude the case of only performing either the fundamental frequency adjustment or the frequency spectrum.

In Step 1007, the standard voice data is reconstructed according to the above conversion and adjustment results to generate target voice data.

Figure 11:
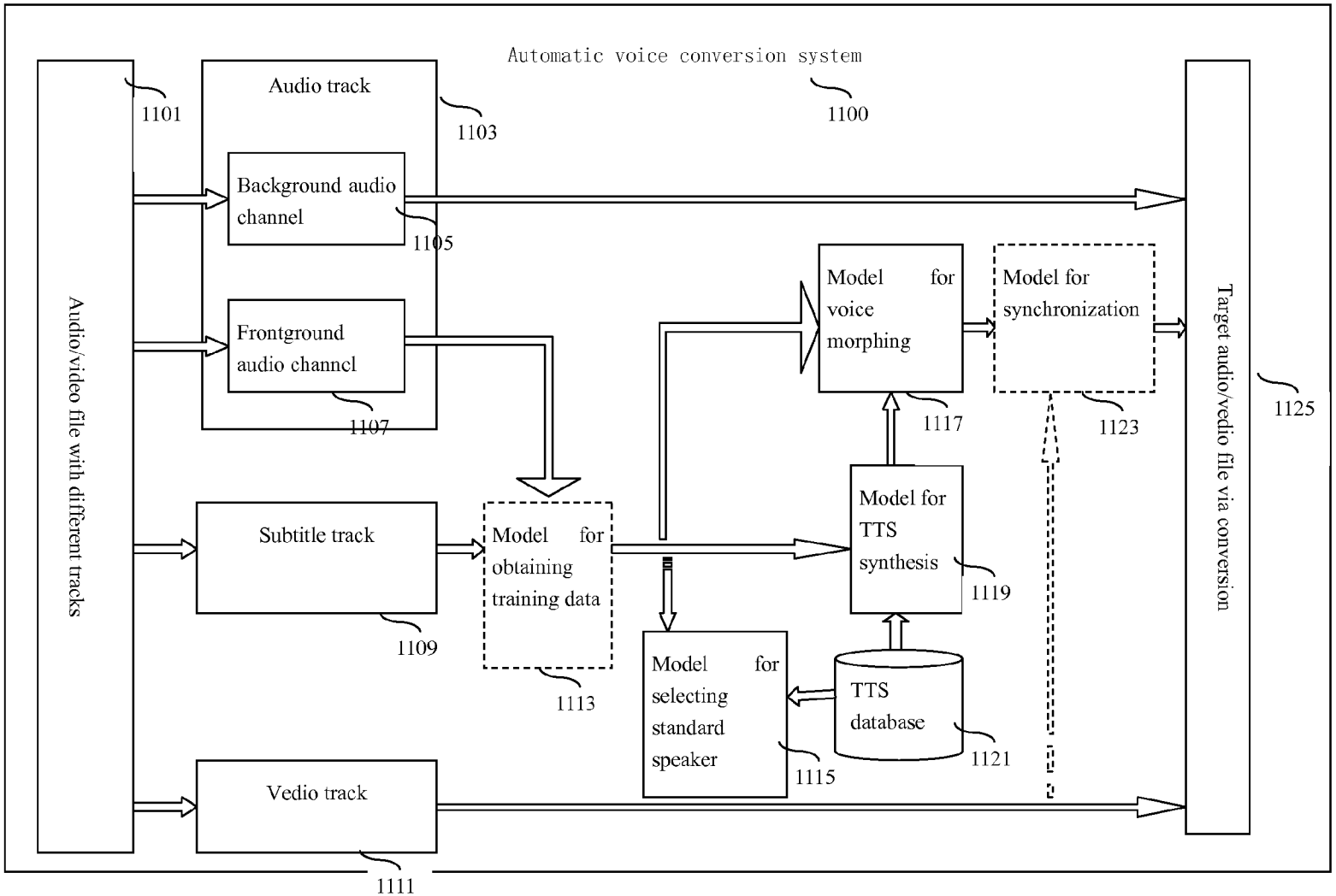
FIG. 11 is a structural block diagram of an automatic voice conversion system.

FIG. 11 is a structural block diagram of an automatic voice conversion system. In one embodiment, an audio/video file 1101 contains different tracks, including an audio track 1103, a subtitle track 1109, and a video track 1111, in which the audio track 1103 further includes a background audio channel 1105 and a foreground audio channel 1107. The background audio channel 1105 generally stores non-speaking voice information, such as background music, special sound effects, while the foreground audio channel 1107 generally stores voice information of speakers. A training data obtaining unit 1113 is used for obtaining voice and text training data, and performing corresponding alignment processing. In the present embodiment, a standard speaker selection unit 1115 selects an appropriate standard speaker from a TTS database 1121 by utilizing the voice training data obtained by the training data obtaining unit 1113. A speech synthesis unit 1119 performs speech synthesis on the text training data according to the voice of the standard speaker selected by the standard speaker selection unit 1115. A voice morphing unit 1117 performs voice morphing on the voice of the standard speaker according to the voice training data of the source speaker. A synchronization unit 1123 synchronizes the target voice information after voice morphing with the source voice information or the video information in the video track 1111. Finally, the background sound information, the target voice information after automatic voice conversion and the video information are synthesized to a target audio/video file 1125.

Figure 12:
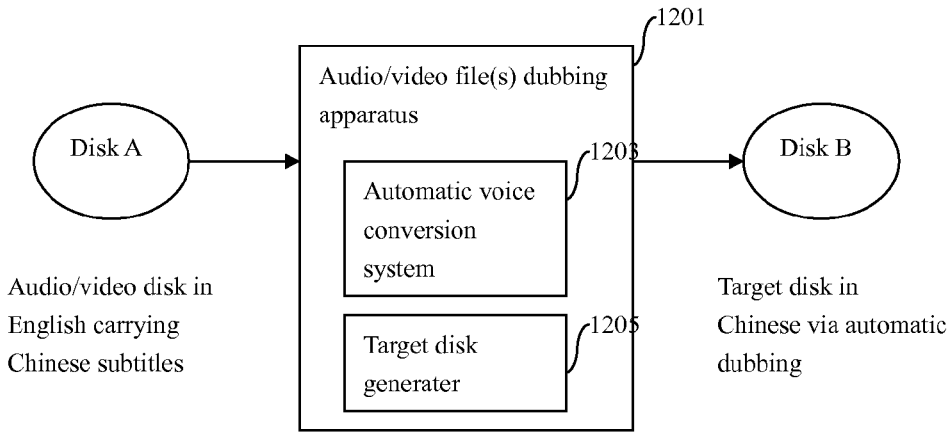
FIG. 12 is a structural block diagram of an audio/video file dubbing apparatus with an automatic voice conversion system.

FIG. 12 is a structural block diagram of an audio/video file dubbing apparatus with an automatic voice conversion system. In the embodiment shown in the figure, an English audio/video file with Chinese subtitles is stored in Disk A. The audio/video file dubbing apparatus 1201 includes an automatic voice conversion system 1203 and a target disk generator 1205. The automatic voice conversion system 1203 is used for obtaining the synthesized target audio/video file from Disk A, and the target disk generator 1205 is used for writing the target audio/video file into Disk B. The target audio/video file with automatic Chinese dubbing is carried in Disk B.

Figure 13:
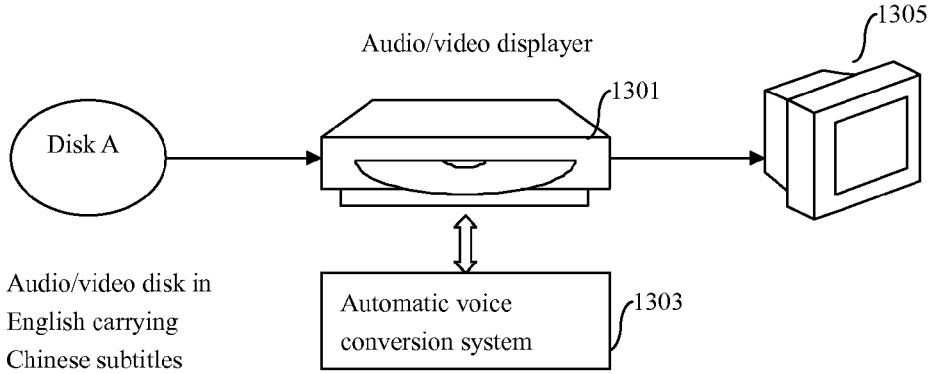
FIG. 13 is a structural block diagram of an audio/video file player with an automatic voice conversion system.

FIG. 13 is a structural block diagram of an audio/video file player with an automatic voice conversion system. In the embodiment shown in the figure, an English audio/video file with Chinese subtitles is stored in Disk A. An audio/video file player 1301, such as a DVD player, gets the synthesized target audio/video file from Disk A by an automatic voice conversion system 1303, and transfers it to a television or a computer for playing.

Those skilled in the art appreciate that, although the invention is described by taking an example of automatically dubbing for an audio/video file, the invention is not limited to such an application situation, and any application situation in which text information needs to be converted into voice of a specific speaker falls within the protection scope of the invention. For example, in software of a virtual world game, a player can convert the input text information into some specific voice information according to his/her favorite role with the invention; the invention may also be used for causing a computer robot to mimic the voice of an actual human to announce news.

Further, the above various operation processes may be implemented by executable programs stored in a computer program product. The program product defines the functions of various embodiments and carries various signals, which include but are not limited to: 1) information permanently stored on unerasable storage media; 2) information stored on erasable storage media; or 3) information transferred to the computer through communication media including wireless communication (such as through a computer network or a telephone network), which especially includes information downloaded from the Internet or other networks.

The various embodiments of the invention may provide a number of advantages, including those listed in the specification and could be derived from the technical scheme itself. Also, the various implementations mentioned above are only for the purpose of description, which can be modified and varied by those having ordinary skill in the art without deviating from the spirit of the invention. The scope of the invention is fully defined by the attached claims.

The invention claimed is:

1. A method for automatically converting voice, the method comprising:

obtaining source voice information and source text information;

selecting a standard speaker from a text-to-speech (TTS) database according to the source voice information;

synthesizing the source text information to standard voice information based on the standard speaker selected from the TTS database; and performing voice morphing on the standard voice information according to the source voice information to obtain target voice information.

2. The method according to claim 1, further comprising a step of obtaining training data, the step of obtaining training data comprising:

aligning the source text information with the source voice information.

3. The method according to claim 2, wherein the step of obtaining training data further comprising:

partitioning and categorizing roles of the source voice information.

4. The method according to claim 1, further comprising a step of synchronizing the target voice information and the source voice information.

5. The method according to claim 1, wherein the step of selecting a standard speaker from a TTS database further comprises:

selecting from the TTS database a standard speaker whose acoustic feature difference is minimal, according to the fundamental frequency difference and the frequency spectrum difference between the standard voice information of the standard speaker in the TTS database and the source voice information.

6. The method according to claim 1, wherein the step of performing voice morphing on the standard voice information according to the source voice information to obtain target voice information further comprises:

performing voice morphing on the standard voice information to convert it into the target voice information, according to the fundamental frequency difference and the frequency spectrum difference between the standard voice information in the TTS database and the source voice information.

7. The method according to claim 5, wherein the fundamental frequency difference includes the mean difference and the variance difference of the fundamental frequencies.

8. The method according to claim 4, wherein the step of synchronizing the target voice information and the source voice information comprises: synchronizing according to the source voice information.

9. The method according to claim 4, wherein the step of synchronizing the target voice information and the source voice information comprises: synchronizing according to the scene information corresponding to the source voice information.

10. A system for automatically converting voice, the system comprising:

means for obtaining source voice information and source text information;

means for selecting a standard speaker from a TTS database according to the source voice information;

means for synthesizing the source text information to standard voice information according to the standard speaker selected from the TTS database; and means for performing voice morphing on the standard voice information according to the source voice information to obtain target voice information.

11. The system according to claim 10, further comprising means for obtaining training data, the means for obtaining training data comprising:

means for aligning the source text information with the source voice information.

12. The system according to claim 11, wherein the means for obtaining training data further comprises:

means for partitioning and categorizing roles of the source voice information.

13. The system according to claim 10, further comprising means for synchronizing the target voice information and the source voice information.

14. The system according to claim 10, wherein the means for selecting a standard speaker from a TTS database further comprises:

means for selecting from the TTS database a standard speaker whose acoustic feature difference is minimal according to the fundamental frequency difference and the frequency spectrum difference between the standard voice information of the standard speaker in the TTS database and the source voice information.

15. The system according to claim 10, wherein the means for performing voice morphing on the standard voice information according to the source voice information to obtain target voice information further comprises:

means for performing voice morphing on the standard voice information to convert it into the target voice information according to the fundamental frequency difference and the frequency spectrum difference between the standard voice information in the TTS database and the source voice information.

16. The system according to claim 14, wherein the fundamental frequency difference includes the mean difference and the variance difference of the fundamental frequencies.

17. The system according to claim 13, wherein the means for synchronizing the target voice information and the source voice information comprises: means for synchronizing according the source voice information.

18. The system according to claim 13, wherein the means for synchronizing the target voice information and the source voice information comprises: means for synchronizing according to the scene information corresponding to the source voice information.

19. A media playing apparatus, the media playing apparatus at least being used for playing voice information, the apparatus comprising:

means for obtaining source voice information and source text information;

means for selecting a standard speaker from a TTS database according to the source voice information;

means for synthesizing the source text information to standard voice information according to the standard speaker selected from the TTS database; and means for performing voice morphing on the standard voice information according to the source voice information to obtain target voice information.

20. A media writing apparatus, the apparatus comprising:

means for obtaining source voice information and source text information;

means for selecting a standard speaker from a TTS database according to the source voice information;

means for synthesizing the source text information to standard voice information according to the standard speaker selected from the TTS database;

means for performing voice morphing on the standard voice information according to the source voice information to obtain target voice information; and means for writing the target voice information into at least one storage apparatus.

* * * * *